United States Patent [19]

Feder

[11] Patent Number: 4,551,354

[45] Date of Patent: Nov. 5, 1985

[54] METHOD FOR METALIZING METAL BODIES

[76] Inventor: Darryl Feder, 3134 Maple Leaf Dr., Glenview, Ill. 60025

[21] Appl. No.: 633,256

[22] Filed: Jul. 23, 1984

Related U.S. Application Data

[62] Division of Ser. No. 374,282, May 3, 1982, abandoned.

[51] Int. Cl.[4] ..... B05D 3/02

[52] U.S. Cl. ..... 427/46; 427/183

[58] Field of Search ..... 427/46, 191, 183

[56] References Cited

U.S. PATENT DOCUMENTS

| | | | |
|---|---|---|---|
| 2,803,559 | 8/1957 | Rutherford . | |
| 3,814,616 | 6/1974 | Kondo | 427/185 |
| 4,304,822 | 12/1981 | Heyl | 427/46 |

*Primary Examiner*—Sam Silverberg
*Attorney, Agent, or Firm*—Norman Lettvin

[57] ABSTRACT

An apparatus and method for metalizing the surface of metal bodies, such as bars, rods and tubes is provided using a substantially enclosed chamber in which the metalizing is caused to occur. An elongated body to be metalized is moved axially into the chamber through an entrance opening while the body is simultaneously rotated, and then passes through a first induction heating coil to pre-heat a portion of the body surface to a selected pre-heat temperature. The pre-heated portion is then advanced past the pre-heating coil to a point where it is subjected to, and bathed by, a flowing stream of metalizing powder entrained within a heated non-oxidizing gas, such as nitrogen, with the flowing stream directed against the pre-heated body portion so that the entrained metalizing powder impinges against and clings to and covers the entire surface of the pre-heated portion. The pre-heated body portion with metalizing powder clinging thereto then moves through a second induction heating coil which heats the body and metalizing powder to a fusing temperature greater than the pre-heat temperature, so as to fuse the metalizing powder to the body. The interior of the chamber is filled with the non-oxidizing gas to prevent entry of air. The moving body with fused metalized surface thereon then exits from the chamber and is arranged to pass through a water quenching station which quenches and cools the metalized body.

4 Claims, 1 Drawing Figure

METHOD FOR METALIZING METAL BODIES

This is a divisional of application Ser. No. 374,282, filed May 3, 1982, abandoned.

FIELD OF THE INVENTION

This invention relates to the metalizing of metal bodies, such as bars and rods and tubes, so as to produce articles, such as chrome plated steel bars and rods, for such ultimate uses as shafts or pins, and chrome plated tubes.

BACKGROUND OF THE INVENTION

There are many fields of manufacture in which metalizing is used to provide bodies, such as bars and rods and tubes of ordinary steel, with an expensive surface layer, treatment, or coating that is fused to the metal, to provide a part that will respond to manufacturing specifications but is less expensive than making the entire body of the same material that the specifications require be only at the surface of the body. Thus, parts such as force transmitting rods, piston rods, shock absorber shafts, bearing shafts, pivot pins, tubes, and the like, are frequently required to provide thereon an exterior surface of chromium, or chrome.

It has been long known that ordinary steels, except for leaded steels or resulphurized steels, provided in bar or pin form, may be chrome surfaced, by plating or the like, to both meet the specifications for desired strength of the part and with the surface character being specially adapted for the environment in which the part is to be used.

However, chromium is a relatively expensive material, and chromium's use in various chemical baths means, by which chrome plating may be effected, is environmentally undesirable and/or difficult and expensive to control.

While metalizing the surface of bars and rods avoids, to substantial extent, the undesirable environmental effects of chemical plating such bodies, the mechanical metalizing techniques presently employed have usually used an open flame torch that burns fuel gases, such as acetylene, propane, or the like in the presence of oxygen, to both preheat the body surface to an elevated temperature and to heat the surface application material, which is initially in powder form, to a temperature at which the molten powder material will fuse with the material of the body. These prior art metalizing techniques have not been wholly successful in metalizing tubes, as the heat of a torch will frequently burn through the wall of the tube.

The problems with said prior technique are that there is both lack of accurate control of the thickness of the layer of the surface application material to the underlying body, and resultant lack of uniformity of the thickness of the layer that is applied by the torch heat. Furthermore, the minimum thickness of the layer of applied material usually obtained by metalizing with an open flame torch, working with powdered metal, is about 0.008 inches, and maximum thickness of layer of applied metal is about 0.015 inches, both of which thickness values are frequently much greater than the thickness of the applied material layer required to be supplied to meet the performance specifications for the metalized part, and this substantially increases the cost of manufacture. A further problem is that when using fine particles of metalizing materials to form a fused surface on an underlying body, the torch heat intensity is frequently so great that it vaporizes, or burns away, a substantial quantity of the finest particles of the metalizing material, resulting in loss of material and economic waste.

SUMMARY OF THE INVENTION

One object of this invention is to provide an improved method for surface metalizing metal bars, rods and tubes in a manner to accurately control the thickness of metalizing surface applied to the underlying body.

Another object of this invention is to provide an improved apparatus for, and method of, surface metalizing bodies with a metalizing powder in a manner that substantially reduces the burn-up loss of the metalizing material.

A further object of this invention is to provide an apparatus and method for surface metalizing of bodies with chrome powder in a manner to provide an accurate control of the thickness of the metalizing layer applied, while simultaneously avoiding economic loss of metalizing powder through vaporization or burning.

Further objects and advantages will become known to one skilled in the art, as these specifications proceed to describe the invention disclosed herein.

In the instant invention, a first induction coil is used to provide, as part of a first step, the heating of an axially moving body, such as a bar or rod or tube, to a selected pre-heat temperature; rotating the body while a powdered metalizing material is flooded onto, or over, the pre-heated body to adheringly deposit a layer of metalizing material onto the body; and then fusing the powdered metalizing material to the body by induction heating the body with metalizing material adhering thereto, at a fusing temperature and in the presence of an inert gas, while recapturing, for later re-use, the non-deposited metalizing powder.

DETAILED DESCRIPTION OF THE DRAWINGS

Figure 1:
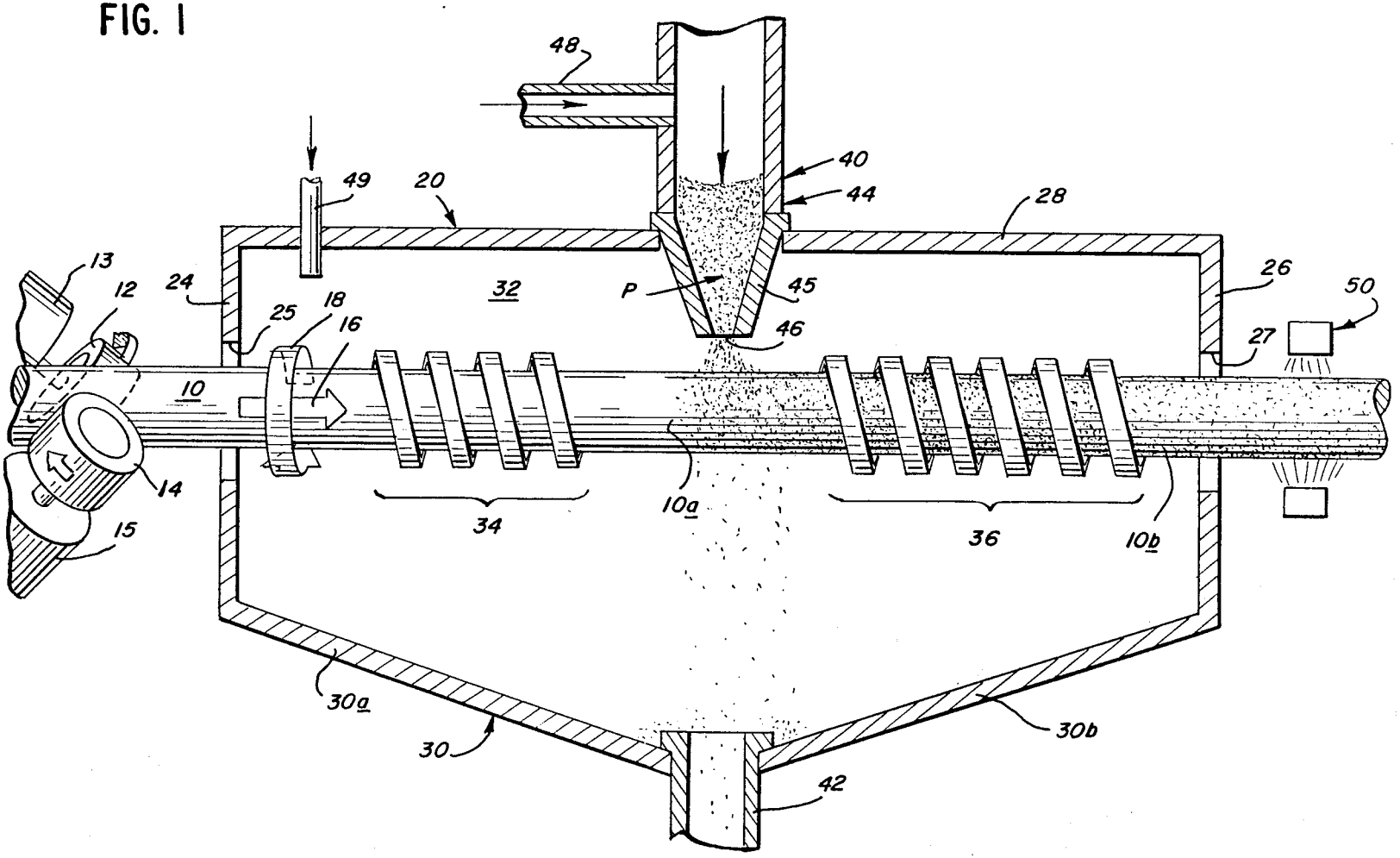
FIG. 1 is a vertical, cross-sectional, view of one form of apparatus for practicing the process of this invention, and illustrating diagrammatically a preferred combination of means and apparatus, for effecting the practice of the process of this invention upon an elongated cylindrical body.

Referring now to the drawing, there is shown, in the vertical, cross-sectional, view of the apparatus for practice of the invention an elongated cylindrical bar 10 of steel, or the like, that is to be metalized. Although the bar 10 is illustrated as being endless, the bar 10 usually will be of some finite length that is greater than the length of the treating apparatus illustrated. The bar is to be advanced through the heating apparatus by means that moves the bar 10 axially, or longitudinally, while simultaneously rotating the bar 10. Such an apparatus, is well known in the art of movement of elongated bodies. Typically, such an apparatus (not shown) would include sets of opposed roller discs located both upstream (ahead of) and downstream (after) a station at which the bar is to be acted upon, with the sets of rollers constructed and arranged to at least support the bar at the elevation shown, relative to the region at which the bar is to be acted upon.

In such prior constructions, the two sets of roller discs would be arranged in an overlapping fashion so as to define a support region above the region of overlap, which would serve as a crotch to cradle the cylindrical body, and the discs would also be arranged so that their rotation would operate to move the cylindrical body axially while the cylindrical body also would be rotated about its longitudinal axes. The drawing, FIG. 1, illustrates, diagrammatically, a type of motion imparting means in the form of a set of inclined drive rollers 12 and 14, which are angled oppositely as shown, and each driven from a source of rotation, such as a power train, or by drive motors 13 and 15, to cause the rollers to purchase, or grip, the bar to cause it to move axially, or longitudinally in the direction of arrow 16, while simultaneously rotating the bar in the direction of arrow 18.

The metal bar 10 is shown moving from left to right through an enclosure, or chamber means, generally 20, which defines, and substantially encloses, an isolated treating chamber 22. The chamber-defining means 20 includes a pair of spaced end walls, respectively entry wall 24 and exit wall 26, a top wall 28, a bottom wall 30 with oppositely sloping sections 30*a* and 30*b*, which pitch toward a central junction, and back and front walls, not seen in FIG. 1. The back wall is spaced behind the drawing sheet and the front wall is spaced forwardly of the drawing sheet, as is understood in such illustrative drawings. The entry wall 24 has a first, or entry, opening 25 therein. The exit wall 26 has a second, or exit, opening 27 therein. The leading end of the bar 10, moving from left to right, enters the substantially enclosed treating chamber 32, that, is bounded by walls 24, 26, 28, and 30 and the back and front walls, through entry opening 25 and exits from chamber 32 through exit opening 27.

Mounted within the treating chamber 32 is a first heating means, 34, in the form of a first electrical induction helical heating coil located adjacent the entry opening 25 and surrounding a portion of metal bar 10. The heating coil means 34 is of any type well known in the art for effecting induction heating in a metal body, such as a bar 10. A second electrical induction, helical, heating coil means 36 is spaced from heating coil means 34, and is located adjacent the exit opening 27 and it surrounds the bar 10 at a point along that bar's travel that is before the bar leaves the treating chamber.

A typical counstruction for the first heating coil means 34, for use with a bar 10 of one inch (1") diameter is a 4-turn coil with an internal diameter (I.D.) of 1 and 3/16 inches, designed to provide a pre-heating, of the bar portion surrounded by coil means 34, to an initial temperature of about 900 degrees F. The second heating coil means 36 is designed to provide an induction heating of the bar portion of one inch (1") diameter surrounded by coil means 36 to a chrome-fusing temperature of approximately 1800 degrees or more, as required, using a 6-turn coil with a 1 and $\frac{1}{4}$ inch I.D. The power consumed by heating coil means 36 is about 100 kilowatts at a frequency of 10 Khz. The temperature developed by an induction heater is a function of the number of turns of the coil heater and its closeness to the body being heated.

The coils 34 and 36 are axially spaced and aligned relative to the bar 10 and its direction of movement, so that a pre-heated portion 10*a* of bar 10 passes through the surrounded core region of coil 36. The pre-heated portion 10*a* of bar 10 is shown positioned between coils 34 and 36, in the course of its longitudinal movement. The bar portion 10*a* is subject to an additional step of the process herein in the said region located between coils 34 and 36.

The region in which the exposed, pre-heated, bar portion 10*a* is located between coils 34 and 36 is positioned directly in the path of an upright, projected, flow passageway that is located within chamber 32, and which extends, in effect, between a discharge nozzle, or spout, 40 and a sump, or return, pipe 42. More specifically, there is provided upon the top wall 28 of chamber defining means 20, a reservoir, or supply tube, 44 from which flows a supply of a metalizing powder, P. The lower end of a reservoir 44 feeds into the upstream end of nozzle 40 whose interior is shaped, as shown, to form a tapered metering funnel 45 which terminates at its lower end in a constructed discharge opening 46. The intake end of reservoir 44 is provided with a constant supply (not shown) of metalizing powder that feeds downwardly from reservoir 44 by gravity, aided by movement of a supply of gas under pressure toward discharge opening 46.

An upstream portion of reservoir tube 44 is provided with a laterally extending connection tube 48 through which is supplied pressurized gas from a source (not shown). Pressurizing gas may also be supplied through reservoir 44 from its inlet end. The gas used for aiding flow of the metalizing powder from funnel discharge opening 46 downwardly across the bar portion 10*a*, is a non-oxidizing gas, such as nitrogen, or a rare gas selected from the group that includes neon and argon. Preferably, the gas is nitrogen under 5 p.s.i. pressure in excess of atmospheric pressure, and pre-heated to a temperature of at least 900 degrees F. The entire interior of treating chamber 32 is also supplied by nitrogen at elevated temperature of at least 900 degrees F., supplied through an inlet tube 49 through the top chamber wall 28.

The metalizing powder 46, and the impelling and entraining nitrogen gas that discharges through opening 46 then flows, as a stream of fluid which entrains metalizing powder 46 and which washes over, or bathes, the pre-heated bar portion 10*a* with metalizing powder. The heat of the pre-heated bar portion 10*a* operates to cause the metalizing powder 46 in the stream of fluid to adhere, or cling, to the pre-heated surface of the bar, and since the bar 10 is being continuously rotated, a continuous coating of clinging powder is provided on bar portion 10*a*.

The washing stream of nitrogen and metalizing powder which passes over bar 10 and moves downwardly below bar portion 10*a*, is recaptured by a sump, or return pipe 42, which conveys the recaptured stream to a recapture apparatus for either recycling both the gas and powder to and through inlet tube 48 or reservoir 44, or recapturing the stream through some other alternate recovery of the powder and gas, together or separately, as desired. The sump, or return, pipe 42 is positioned on the intake side of a diaphragm-type pump (not shown), as is available for use in a flowing gas-particle recovery system.

As the bar portion 10*a* is being coated with the metalizing powder 46 which clings to said bar portion, the axially moving bar 10 operates to move bar portion 10*a* into and through the open core of heating coil 36, where an increased induced temperature, in excess of approximately 1800 degrees F., effected in bar portion 10*a* operates to fuse the clinging powder 46 to the bar position 10*a* to form a continuous metalized surface on bar 10. The fused, metalized, bar portion is designated at 10*b*.

As an example of metalizing material used, alloys sold by Colmonoy Corporation of Detroit, Mich. have been employed in metalizing bars and tubes. Specifically, Colmonoy Alloy Nos. 62 and 63 having a Rockwell Hardness (C Scale) of 58–63 and a specific gravity of 7.8, have a melting point of 1875 degrees F. Other alloy numbers have greater specific gravity values and higher melting point temperatures to a maximum of about 2250 degrees F.

After the metalized bar portion 10*b* with fused surface exits the chamber 32 through exit opening 27, said metalized bar portion is caused to pass through a water quench station 50 in the form of a ring, or annulus, from which one or more streams of cooling water are projected inwardly and directed against the metalized surface of metalized bar portion 10*b*.

The use of this invention has the capability of providing a metalized surface of a thickness between 0.002–0.015 inches. It will be observed that the minimum thickness of the metalized surface, or layer, provided by practice of this invention is as small as about $\frac{1}{4}$ of the minimum thickness that could be achieved through use of the prior art, torch, techniques discussed above, and this leads to a substantial economy in use of metalizing powder, the cost of which is presently about \$6.–\$8. per pound. Furthermore, when using the torch technique only about a maximum of 70% of the metalizing material would be deposited on the surface of the articles being metalized, while with the practice of the invention disclosed herein, at least 90% of the metalizing material is deposited on the surface of the articles, providing a 90% efficiency factor for usage of the metalized powder.

After the metalized bar portion has been quenched and cooled, the metalized bar may be cut into axial lengths as desired to provide bar segments for further finishing operations by subsequent machining or other operations.

While the interior of the heating chamber 22 is pressurized by gas under pressure, and the size of entry opening 25 and exit opening 27 could permit escape of some gas and entrained metalizing powder therethrough, it will be recognized that means such as gaskets and recovery systems, could be employed to seal against, or limit, loss of fluid and entrained metalizing powder through such openings. However, it is believed that the losses will be, or could be made, so insubstantial as to not demand use of expensive loss prevention measures and costs associated therewith.

While I have disclosed herein an apparatus and method for metalizing certain regular metal bodies, persons skilled in the art will appreciate that the invention herein may be used for metalizing of other or irregular bodies, and it is intended to cover all aspects of my invention wherein, as limited solely in the claims appended hereto.

What is claimed and desired to be secured by Letters Patent of the United States is:

1. A method of metalizing an elongated body of metal comprising the steps of pre-heating by induction a portion of the length of the body to a temperature at which metalizing powder will cling and adhere to the preheated body's exterior surface; then bathing the exterior of the preheated body portion in a flowing stream of a pre-heated metalizing powder entrained in a fluid carrier of a pre-heated, pressurized, non-oxidizing gas by moving the metal body axially along a path that passes through, and transverse of the direction of flow of, the flowing stream of pre-heated metalizing powder, while simultaneously rotating the metal body about its longitudinal axis, so that particles of the metalizing powder will impinge upon and cling to the entire surface of the pre-heated body; and then fusing the clinging, metalizing, powder to the body at a fusing temperature that is higher than the pre-heat temperature of both the body and the metalizing powder.

2. A method as in claim 1 wherein the step of preheating the body is effected by electric induction heating of a portion of the body before that portion of the body is bathed by the flowing stream of pre-heated metalizing powder entrained in a fluid carrier of preheated, pressurized, non-oxidizing gas; and wherein the step of fusing of the clinging metalizing powder to the body is effected by electric induction heating of the body in the absence of an oxidizing agent to a temperature greater than the pre-heat temperature of the body, and at a temperature at which the clinging metalizing powder fuses to the body portion.

3. A method as in claim 1 wherein the bathing of the pre-heated elongated body in a flowing stream of metalizing powder entrained in a fluid carrier is effected by directing a flowing stream, of a metalizing powder entrained in a fluid carrier of a heated non-oxidizing gas, to move along a path that is directed transversely of the direction of movement of the elongated body and against the exterior of the pre-heated body portion, while simultaneously rotating the body to expose all of the pre-heated exterior surface of said body portion to impingement thereagainst by the directed flowing stream of metalizing powder, to effect a clinging of the metalizing powder to the entire surface of the preheated body portion.

4. A method as in claim 3 including the step of recovering the pre-heated gas stream and the entrained preheated metalizing powder that does not cling to the surface of the pre-heated body.

* * * * *